United States Patent [19]

Lang

[11] Patent Number: 4,762,241

[45] Date of Patent: Aug. 9, 1988

[54] CONTAINER WITH SUPPLEMENTAL OPENING FOR EXTRACTING CONTENTS

[76] Inventor: Richard R. Lang, 6343 Milton St., Philadelphia, Pa. 19138

[21] Appl. No.: 11,007

[22] Filed: Feb. 5, 1987

[51] Int. Cl.[4] ..... B65D 39/00

[52] U.S. Cl. ..... 215/250; 215/1 R; 215/306; 215/329

[58] Field of Search ..... 215/250, 306, 1 R, 329

[56] References Cited

U.S. PATENT DOCUMENTS

| | | | |
|---|---|---|---|
| D. 25,056 | 1/1896 | Renziehausen et al. | D9/370 |
| D. 175,196 | 7/1955 | Suttle | D9/370 |
| D. 225,975 | 1/1973 | Danjczek | D9/370 |
| D. 229,606 | 12/1973 | Buchtel | D9/370 |
| D. 240,017 | 5/1976 | Troft | D9/371 |
| 608,864 | 8/1898 | Jaquet | 215/1 R |
| 1,019,022 | 3/1912 | Cadwell | 215/1 R |
| 1,348,062 | 7/1920 | Shook | 215/1 R |
| 2,203,266 | 6/1940 | Leviseur | 215/250 X |
| 2,779,472 | 1/1957 | Febbraro | 215/1 R X |
| 2,838,768 | 6/1958 | Fischett | 215/306 X |
| 3,124,264 | 3/1964 | Waisberg | 215/1 R X |
| 3,596,829 | 8/1971 | Gardner | 215/250 X |
| 4,121,103 | 10/1978 | Calhoun | 250/343 |

*Primary Examiner*—Donald F. Norton

*Attorney, Agent, or Firm*—Steele, Gould & Fried

[57] ABSTRACT

A container especially for use with viscous substances has both a primary opening and a supplemental opening. The primary opening is at an upper point in the container, whereby contents are extracted due to gravity, when tilting the container. A supplemental opening with removable closure is provided at a lowermost point in the container, for also extracting contents under gravity feed. The supplemental opening is preferably located at the end of a slope, causing material in the container to accumulate over the supplemental opening. Particular removable closures include plugs, tethered plugs and frangible panels.

10 Claims, 1 Drawing Sheet

CONTAINER WITH SUPPLEMENTAL OPENING FOR EXTRACTING CONTENTS

BACKGROUND OF THE INVENTION

1. Field of the Invention

This invention relates to the field of containers, especially for consumer products, and in particular to a bottle for viscous substances having an internal contour adapted to accumulate the viscous substance at a lowermost point in the container when upright, and a supplemental opening with a removable closure at the lowermost point for removing the accumulated viscous substance under gravity feed.

2. Prior Art

Typical containers for consumer products hav substantially-flat inside bottom contours or domed bottom contours. When such containers are nearly empty, the contents of the container are spread more or less evenly around the circumference and over a relatively large area. Surface tension and wetting effects cause a quantity of the material, especially viscous liquid material such as shampoo, to cling to the bottom of the container. Material also clings to the side walls when the container is tilted upside down in attempts to extract the contents. Frequently, users of shampoo, thick food products such as salad dressing, sauces, ketchup and similar viscous materials store the containers upside down in order to cause the viscous material to accumulate at the primary closure on the primary opening at the top of the neck of the container, e.g. bottle. Usually, the closure is a threaded cap. While such a technique is effective at extracting the contents of containers, and will allow the user to use the "last drop" of contents, the procedure is cumbersome.

Some containers for liquid products have irregular bottom contours. U.S. Pat. No. Des. 225,975 - Danjczek discloses a bottle for use as an ink well, including means defining a narrowing cross section terminating at the bottom surface along a line. The last portion of ink or the like is confined along the line at the bottom and can be extracted. The bottom forms a trough defined by the inner bottom walls. The material of course also can be extracted through the primary opening.

Users who desire to accumulate material in a container at a relatively confined bottom area could also employ the container of U.S. Pat. No. Des. 175,196 - Suttle. This container has a flattened side upon which the container can be rested while tilted, to thereby accumulate material at the edge of the bottom. This is effective to accumulate viscous material in a relatively smaller area and will presumably allow the user to extract a greater proportion of the material by avoiding undue wetting across a wide, flat bottom surface. However, the material still must be extracted through the primary opening and wetting of the material along the sides of the bottle as the material flows to the primary opening will make it impossible to promptly extract most or all of the material. According to known disclosures, wetting of the sides of the container is unavoidable when tilting the container, and the contents cannot be completely extracted.

Not all containers are flat on the inner walls of their bottoms. U.S. Pat. No. Des. 25,056 shows a bottle in which the inner contour of the bottom is domed. When this container is nearly empty, the contents will accumulate in an annular area near the side walls. Similarly, U.S. Pat. No. 4,121,103 - Calhoun, in connection with means for detecting residual contents in containers shows as alternatives both a domed container and a container with a sloping bottom. In connection with the domed bottom residual material accumulates in an annular configuration. In the sloping bottom the material accumulates at one side. Neither of these patents teaches a supplemental opening with removable closure at the lowermost point, that can be opened by the user when the contents of the container are nearly gone. Therefore the user is unable to extract the last portion of the contents because by tilting the bottle to cause material to flow to the neck of the container, and thereby allowing wetting of the sides of the bottle, complete removal of the material is precluded.

Some containers such as cans for cooking oil or fuels, container drums and other large volume containers often have supplemental openings for admitting air to the container to speed draining. These supplemental openings are typically located at an uppermost point in the container or at an upper point when the container is tilted for pouring.

According to the invention, a bottle particularly of the type used for viscous consumer products is provided with a supplemental opening with a removable closure at the bottom in the form of a plug a tethered plug or a frangible panel. The supplemental opening is disposed at a lowermost point in the container, for example at the bottom of a slope along the bottom. The inner surface of the bottom, i.e., the surface defining the bottom of the storage volume, forms a flat or curving slope leading to the supplemental opening. As the contents of the material are exhausted, the last bit of material accumulates directly over the supplemental opening. When extracting the last portion of the contents, wetting of the inner surface occurs only immediately adjacent the supplemental opening, and not over a large area of a material flow path leading from the bottom of the container along the sidewalls to the primary closure. The bottom can be configured in a flat sloping, multiple-surface-slanted or roundly-slanted configuration. The supplemental opening can be placed along the lowermost bottom edge at a sidewall or in the bottom. The bottom can be of varying thickness defining an incline leading to the supplemental opening or of uniform thickness, the bottom wall being disposed at a tilt toward the supplemental opening.

SUMMARY OF THE INVENTION

It is an object of the invention to facilitate the removal of liquids, and particularly viscous wetting substances, from containers.

It is also an object of the invention to minimize wetting of container inner walls as required to extract a substance from a container by tilting the container.

It is furthermore an object of the invention to provide an improved container without substantially increasing the cost thereof.

These and other objects are accomplished by a container especially for use with viscous wetting substances having both a primary opening and a supplemental opening with removable closure. The primary opening is at an upper point in the container, whereby contents can be extracted through the primary opening due to gravity flow, by tilting the container. A supplemental opening is provided at a lowermost point in the container, also for extracting contents under gravity feed, however, without tilting the container. Particularly supplemental closures include plugs, tethered plugs and frangible panels.

BRIEF DESCRIPTION OF THE DRAWINGS

There is shown in the drawings the embodiments that are presently preferred, it should be understood, however, that the invention is not limited to the precise arrangements and instrumentalities shown in the drawings, wherein.

DETAILED DESCRIPTION OF THE PREFERRED EMBODIMENTS

Figure 1:
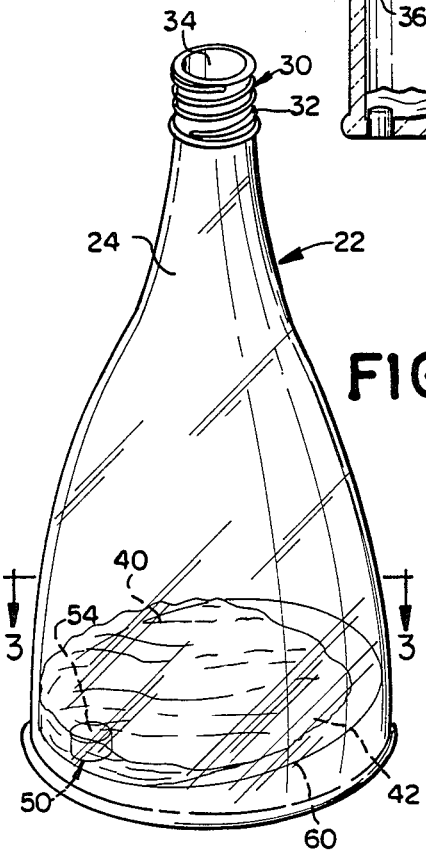
FIG. 1 is a perspective view of a container according to the invention.
Figure 2:
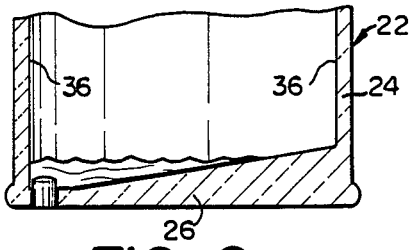
FIG. 2 is a partial section view showing the bottom area of the container.
Figure 3:
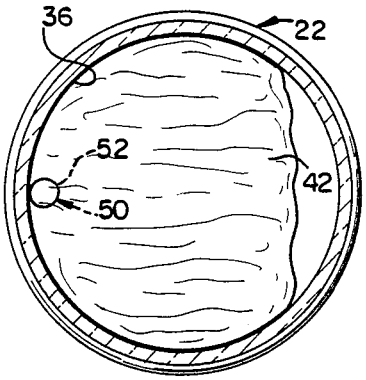
FIG. 3 is a section view along lines 3—3 in FIG. 1.

As shown in perspective in FIG. 1, a typical container 22 such as a shampoo bottle, ketchup bottle, etc., has a primary opening 30 adjacent its upper end, adapted to receive a closure in the form of a sealing cap (not shown) for confining the contents to the container. The sealing cap may be a threadable cap attachable by means of threads 32, or may be a press fit closure or the like. In any event, the container 22 is tilted to extract the contents such that gravity causes the contents to flow out through primary opening 30 after flowing along inner wall 34 of the neck. In so doing, the contents of the container wet the inner surfaces of container walls 24, as the contents flow by gravity to the primary opening.

The contents of the container may be more or less viscous. If the contents are a very viscous liquid, then a substantial volume of the contents cling to the sides of walls 24 as the contents flow along the walls. Material thus fixed to the walls 24 cannot be removed by the usual gravity flow through the neck unless the user is willing to wait quite some time. According to the invention, the surface area directly exposed to wetting by contents 40 is decreased in comparison to conventional containers, as the contents 40 are exhausted because the container need not be tilted to extract the last bit of material. A sloping bottom wall 60, namely the upper surface of the bottom, defines a lowermost receptacle of limited horizontal surface area. Therefore, a confined or narrow accumulation of substance 40 occurs over supplemental opening 50, minimizing wetting. The supplemental opening 50 has a closure which may be a plug 54, for example, inserted in a hole at the lowermost portion of the container, in bottom 26.

Effects of viscosity and surface tension still cause a portion of contents 40 to remain on surfaces that are wetted. As the contents are nearly exhausted in a typical container, a larger and larger proportion of the remaining contents 40 are devoted to wetting the surface of the container. Moreover, as the container is tipped, the wetting of the surface can so retard material flow, and thereby reduce the rate at which the last portion of contents flow to the outlet, to cause the user to discard a container that still has some usable substance therein.

By sloping the bottom wall 26 and placing a supplemental opening adjacent the lowermost point, the invention allows the user to extract the contents without tilting the container and thereby without wetting the internal surfaces 36 of walls 24. The material accumulates in a reduced area 42 adjacent supplemental opening 50. In the event supplemental opening 50 is closed by a simple plug, the user simply pulls the plug out of the hole 64 in which it is resiliently engaged, or pushes the plug through to the inside of the container, free of the hole. This allows the last portion of contents to flow out through supplemental opening 50, without unnecessarily wetting any additional surface area of the container.

Figure 4A:
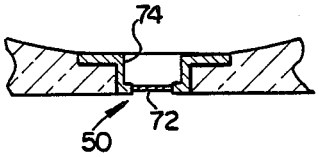
FIGS. 4, 5 and 6 are section views of alternative embodiments, corresponding to FIG. 2.
Figure 4:
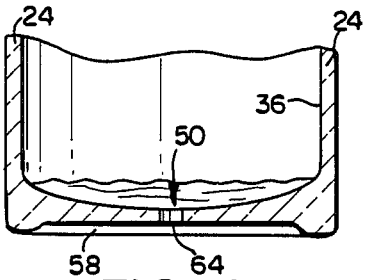

As shown in FIG. 4, the sloping bottle can be arranged such that the lowermost point occurs near the center of the container and not adjacent the sidewalls. In this embodiment, the internal surface of the container is symmetrical. At any rate, the supplemental opening 50, in this case hole 64, occurs at the lowermost point of the container. The integral contour could also be flat, however, the result of a flat configuration is an increase in the surface area wetted as the consents are extracted.

FIG. 4*a* shows an alternative embodiment in which the hole 64 is plugged by a frangible panel. A weakened frangible panel 72 is provided with an annular mounting portion 74, the latter being sealed to the container. Panel 72 and mounting 74 are preferably integral, however, they can be adhesively attached portions of different materials or the like. Similarly, flange 74 can be affixed adhesively, welded to the plastic or glass of the container, or likewise affixed in a leak-proof manner. When the user is satisfied that the container is empty, i.e., when tilting the container no longer extracts contents promptly, frangible panel 72 is broken, for example by finger pressure, while the container is upright. This allows the last portion of contents 40 to flow by force of gravity through the supplemental opening 50, without wetting the sides of the container.

Figure 5:
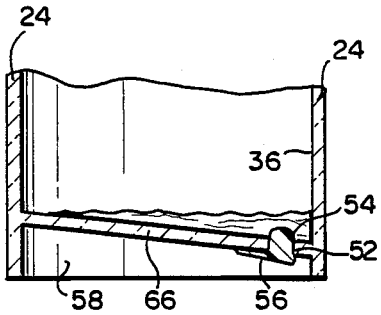

FIG. 5 shows an alternative embodiment for sloping the inner surface of the bottom wall. A sloping thin bottom wall 66 is provided, thereby defining a cavity 58 that is higher on one side than the other. Adjacent the lowermost side, a plug 54 is resiliently received in hole 52, thereby closing the supplemental opening. Acccording to FIG. 5, the supplemental opening can be easily reclosable, the plug 54 remaining captive by means of tether 56. Tether 56 is adhesively attached at a space from hole 52, and is removable from the hole to remove the contents. If the user desires to reclose the supplemental opening, he merely pushes the plug 54 back into hole 52.

Typical containers in use for storage of viscous substances such as shampoo are frequently made of hard plastic, but may also be made of glass or even metal. In connection with a usual volume of 100 to 500 milliliters (3.4–17 fluid ounces), the containers are normally of flexible plastic with a thickness of 1–3 millimeters (0.04–0.1 inch). In such a container, a supplemental opening sufficient to drain the viscous substance at a reasonable rate is around 5 millimeters (0.2 inch). Of course, the particular dimensions of the opening will vary according to the viscosity and the rate of drainage required.

Figure 6:
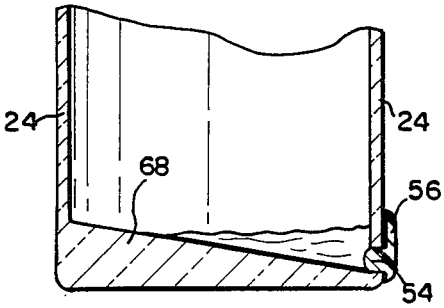

According to FIG. 6 the supplemental opening is placed at the lowermost point of the container, however, the supplemental opening is through sidewall 24 rather than through the bottom. The opening nevertheless occurs at the lowermost point. FIG. 6 also illustrates a tethered plug in which a plug 54 is permanently attached to the container by means of a tether 56, adhesively attached to the outer surface of container wall 24 at a space from the plug. Tether 56 is a resilient material, preferably the same soft rubber or plastic as plug 54, and may also be attached by means of heat welding. The tether may hav thin portions defining preferential folds. The plug may also be an integral extension of the molded bottle.

Figure 7:
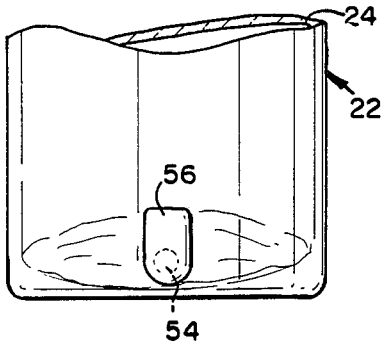
FIG. 7 is an elevation view of the bottom portion of the container, showing a supplemental opening and as depicted in FIG. 6.

As shown in FIG. 7, the tether 56 is preferably of a substantial width in comparison to plug 54, thereby providing a smoothly rounded hump rather than a sharply defined projection on the container wall. This reduces the possibility of inadvertently opening the supplemental opening. The tether does not extend substantially above the surface, whereby the container can still be processed with automatic handling machines.

The particular shape of the inner walls and bottom can define a truncated cylinder as in FIGS. 1, 5 and 6, or other shapes can be used. A minimum surface area exposed to wetting is achieved when the container is conical, with the apex of the cone at the supplemental opening.

The invention having been disclosed, a number of additional variations will now occur to persons skilled in the art. Reference should be made to the appended claims rather than the foregoing specification as indicating the true scope of the invention.

What is claimed is:

1. An improved container of the type having a vessel defined by a bottom with an outer surface contoured to support the container when placed on a flat surface, side walls substantially perpendicular to the outer surface of the bottom, and a top, a primary opening being disposed in the top and dimensioned such that the contents of the container can be poured by tilting the container whereupon the contents flow out normally through the top, the improvement comprising:

the bottom being a solid wall having a flat inner surface inclined relative to the flat surface against which the bottom is placed; and, at least one of the bottom and a side wall of the container having a supplemental opening with removable closure in the form of a hole in said one of the bottom and the side wall and a removable plug therein, the supplemental opening being disposed at an edge of the flat inner surface and at a lowermost point in the container, at a junction between the bottom and the side wall whereby the contents can alternatively be removed through the supplemental opening.

2. The container of claim 1, wherein the bottom is solid and defined by material of varying thickness, the outer surface of the bottom being flat, and the material defining the bottom being thinner adjacent the supplemental opening and thicker at a distance from the supplemental opening.

3. The container of claim 1, wherein the supplemental opening is a simple hole in the bottom, the bottom being solid and the removable closure including a removable resilient plug engaged in the hole in the bottom.

4. The container of claim 3, further comprising means affixing the plug to the vessel at a distance from the hole.

5. An improved container of the type having a vessel defined by a bottom with an outer surface contoured to support the container on a flat surface, side walls substantially perpendicular to the outer surface of the bottom, and a top, a primary opening being disposed in the top and dimensioned such that contents of the container can be poured by tilting the container whereupon the contents flow out normally through the top, the improvement comprising:

the bottom having an inner surface inclined relative to the flat surface; and, at least one of the bottom and a side wall of the container having a supplemental opening with a removable closure in the form of a hole in said one of the bottom and the side wall and a removable plug therein, the supplemental opening being disposed at a lowermost point in the container, whereby the contents can alternatively be removed through the supplemental opening, and wherein the bottom of the vessel is defined by material of substantially constant thickness, a lower surface of the material of the bottom being spaced from the flat surface by a smaller distance adjacent the supplemental opening and by a greater distance across the bottom from the supplemental opening.

6. A container for dispensing a viscous substance, comprising:

a vessel with solid walls and a solid bottom bounding an inner contour defining a lowermost point at which the viscous substance accumulates when the container is upright, the inner contour being a flat surface inclined relative to an axis of the container, whereby the viscous substance accumulates at a lowermost edge of the inner contour adjacent to a side of the container;

means defining a primary opening at an upper point in the vessel, for dispensing the viscous substance by tilting the container; and, means defining a supplemental opening at said lowermost point, and a removable plug for the supplemental opening, the opening being a hole directly through the solid bottom of the vessel at said lowermost point, the hole being normally blocked by the removable plug, whereby the supplemental opening is openable to extract a last bit of the viscous substance at said lowermost point, without tilting the container, and whereby wetting of inner surfaces of the container is minimized.

7. The container of claim 6, wherein the plug is tethered to the container at a distance from the hole.

8. The container of claim 6, wherein the removable plug for the supplemental opening comprises a frangible panel.

9. The container of claim 6, wherein the closure for the primary opening is a threaded cap sealably attachable to the primary opening at a neck of the vessel.

10. An improved bottle of the type having a removable and replaceable cap for dispensing quantities of material by removing the cap and tilting the bottle, the botttle being substantially cylindrical and having a bottom adapted to rest the bottle perpendicular to a flat surface on which the bottle is placed, the improvement comprising:

the bottle having a solid bottom and and inner surface of the bottom of the bottle being planar and inclined relative to the bottom, the inner surface being flat and higher on one side of the bottle than on an opposite side of the bottle; and, the bottom having a through hole at said opposite side of the bottom with an easily removable plug disposed in the hole;

whereby contents are extracted from the bottle normally through the gap until the bottle is nearly emptied by tilting the bottle, whereupon said contents wet inner surfaces of the bottle between the bottom and the top the plug being removable from the hole in the bottom while the bottom is upright for extraction of a last bit of the contents, without wetting said inner surfaces of the bottle.

* * * * *